US006163305A

United States Patent [19]

Murakami et al.

[11] Patent Number: 6,163,305

[45] Date of Patent: Dec. 19, 2000

[54] LOOP ANTENNA DEVICE

[75] Inventors: Yuichi Murakami; Eiji Mushiake; Rikuo Hatano; Koji Aoki, all of Aichi, Japan

[73] Assignee: Aisin Seiki Kabushiki Kaisha, Kariya, Japan

[21] Appl. No.: 09/320,642

[22] Filed: May 27, 1999

[51] Int. Cl.[7] ..... H01Q 7/08

[52] U.S. Cl. ..... 343/788; 343/867

[58] Field of Search ..... 343/788, 867, 343/742, 744, 748; H01Q 7/04, 7/06, 1/52, 21/24, 7/08

[56] References Cited

U.S. PATENT DOCUMENTS 3,719,950 3/1973 Bukhman et al. ..... 343/788

FOREIGN PATENT DOCUMENTS 41 05 826 9/1991 Germany .

10-51225 2/1998 Japan .

*Primary Examiner*—Michael C. Wimer

*Attorney, Agent, or Firm*—Sughrue, Mion, Zinn, Macpeak & Seas, PLLC

[57] ABSTRACT

A loop antenna has a first antenna generating a first magnetic field and a second antenna generating a second magnetic field such that the first magnetic field and the second magnetic field each have a different axis. A serial resonant circuit and a parallel resonant circuit are provided for the first antenna and the second antenna, respectively. The serial resonant circuit has a ferrite member, a first coil wound around the ferrite member, a resonant capacitor, and a power source connected thereto in series. The in-series connection of the resonant capacitor and the power source are connected across the first coil. The parallel resonant circuit has a link coil wound around the ferrite member, a second coil connected to the link coil in series and wound around a member outside the ferrite member, and a resonant capacitor connected in parallel to the series connection of the second coil and the link coil.

4 Claims, 5 Drawing Sheets

LOOP ANTENNA DEVICE

BACKGROUND OF THE INVENTION

1. Field of the Invention

The present invention is directed to a loop antenna device which generates two different magnetic fields, and in particular to the structural improvement of a loop antenna which has two antennas for generating thereat two different or orthogonal magnetic components, respectively.

2. Related Prior Art

One of the conventional loop antenna devices is disclosed in German Patent Publication DE 4105826. The conventional loop antenna device includes a first antenna A1 and a second antenna A2. The first antenna A1 has a coil L2 wound around a ferrite rod or bar B and a resonant capacitor C2 connected thereto in parallel which constitutes a parallel resonant circuit. The second antenna A2 has a circular coil L1 accommodating therein the ferrite bar B and a resonant capacitor C1 connected in parallel to the circular coil L1 which constitutes a parallel resonant circuit. The ferrite bar B is also wound with a coil L3 to which an amount of current is fed from a power source S.

In the foregoing structure, the ferrite bar B is rotated through an angle θ so as to establish a magnetic coupling between the first antenna A1 and the second antenna A2.

Thus, an equivalent circuit shown in FIG. 7(B) can be established in accordance with the resultant condition of the loop antenna device, and a magnetic field component Hz generated by the coil L1 makes an angle, of 90 degrees relative to a magnetic field component Hy generated by the coil L2. It is to be noted that the magnetic field component Hz, the magnetic field component Hy and a magnetic field component generated by the coil L3 extend in the z-direction, y-direction, and x-direction, respectively.

In another conventional loop antenna device which is disclosed in Japanese Patent Laid-open Print No. 10(1998)-51225, a pair of spaced loop antenna each of which is formed of a coil-wounded ferrite bar are arranged between two metal plates in such a manner that a shield plate is interposed between the loop antennas which cross each other at right angles.

However, in the former conventional loop antenna device the inclined condition of the ferrite bar B relative to the circular coil L1 or the angle θ therebetween has to be kept for continuous electromagnetic coupling of the first antenna A1 and the second antenna A2. This requires a fixing means for each antenna, resulting in that the structure of the loop antenna device per se becomes complex. In addition, dead spaces are defined between the ferrite bar B and the circular coil Li by which a miniaturization of the loop antenna per se gets difficult.

In the latter conventional loop antenna device wherein both loop antennas cross at right angles, devices such as an a R-C circuit and transformer for establishing a phase difference of 90 degrees between magnetic components generated at both loop antennas are required, resulting in that the loop antenna device per se becomes large and complex in structure.

SUMMARY OF THE INVENTION

It is, therefore, one of the objects of the present invention to provide a loop antenna device without the foregoing drawbacks.

It is another object of the present invention to provide a loop antenna device which is simple and miniaturized in construction.

In order to attain the foregoing objects, a loop antenna device includes: a first antenna having a first coil at which a first magnetic field is generated, a link coil extending from one end of the first coil and a second antenna having a second coil at which a second magnetic field is generated such that an axis of the first magnetic field and an axis of the second magnetic field are different or cross in an orthogonal manner to each other, the second coil being magnetically coupled to the link coil by an alignment thereof with the second coil.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF THE PRESENT INVENTION

Preferred embodiments of the present invention will be described hereinafter in detail with reference to the accompanying drawings.

Figure 1A:
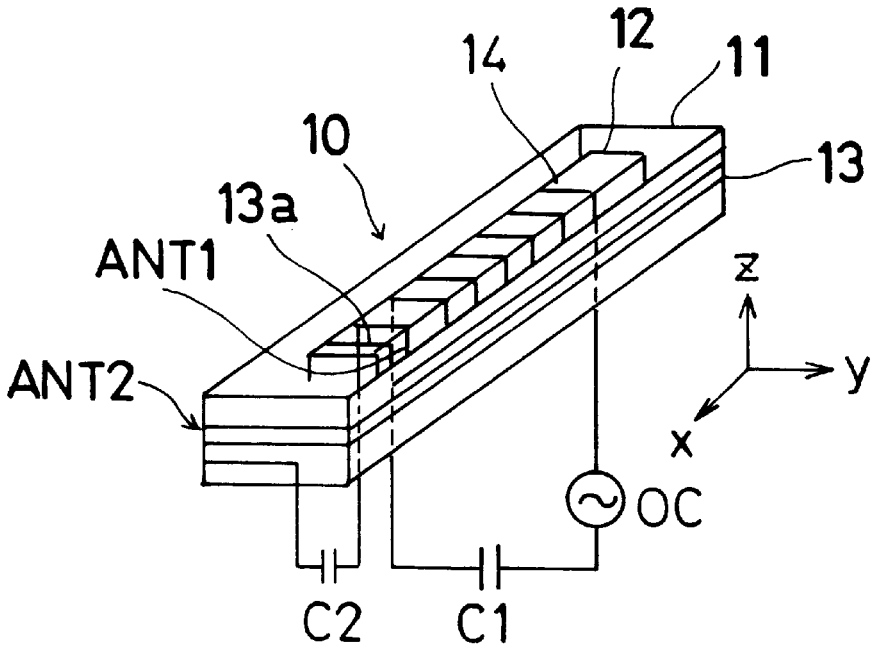
FIG. 1(A) is a perspective view of a first embodiment of a loop antenna device in accordance with the present invention.
Figure 1B:
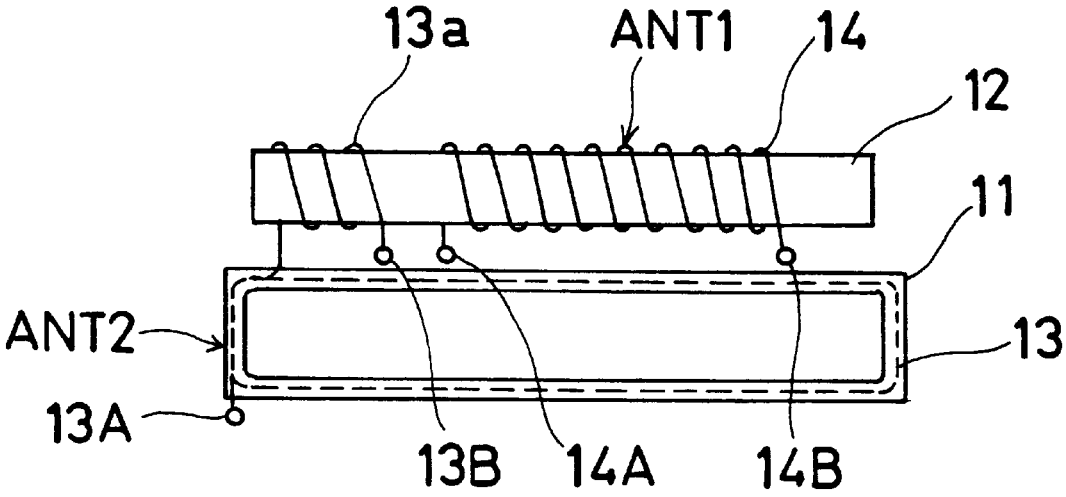
FIG. 1(B) is a view showing how coils are wound in first and second antennas in the loop antenna device shown in FIG. 1(A)

Referring first to FIGS. 1 (A) through 3, a loop antenna device 10 includes a first antenna ANT1 and a second antenna ANT2. The first antenna ANT1 is constructed such that a first coil 14 formed of a good electric conductive material such as cooper is wound around a thin rectangular prism ferrite member 12 which is Mn-Zn family or Ni-Zn family material for increasing antenna efficiency. The ferrite member 12 can be formed into a thin round prism configuration.

The second antenna ANT2 is so configured as to be a closed rectangular loop member having at its center portion a rectangular opening in which the ferrite member 12 is placed such that a clearance is defined therebetween. The second antenna ANT2, which is similar to the ferrite member 12 in shape, is configured such that a second coil 13 formed of a good electric conductive material is wound around a bobbin 11 formed of a resin such as an ABS synthetic resin or polycabronate (PC) resin. One end portion of the second coil 13 is extended to one end portion of the ferrite 12 and is wound a determined number of times therearound so as to constitute a link coil 13*a*. Thus, as can be seen from FIG. 1(B), the second antenna ANT2 is provided with the second coil 13 only around the bobbin 11, while the first antenna ANT1 is provided with both the first coil 14 and the link coil 13*a* around the ferrite member 12. It is to be noted that FIG. 1(B) indicates conceptually how the coils 13 and the coils 14 and 13*a* are wound around the bobbin 11 and the ferrite member 12 of the second antenna ANT2 and the first antenna ANT1, respectively. The outer configuration of the loop antenna device 10 shall not be determined from the illustration of FIG. 1(B).

A resonant capacitor C2 is connected across a terminal ends 13A and 133 of the first coil 13 of the first antenna ANT1 which are at a side of the bobbin 11 and a side of the ferrite member 12, respectively. A series of a capacitor C1 and a power supply or oscillator OC are connected in series across terminal ends 14A and 143 of the second coil 14 wound around the ferrite member 12.

Figure 2:
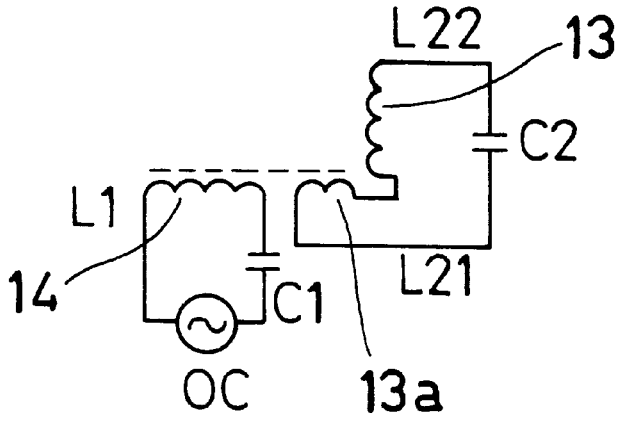
FIG. 2 is an equivalent circuit of the loop antenna device shown in FIG. 1(A)

Thus, the first antenna ANT1 is provided with a series resonant circuit which is constituted by the series connection of the first coil 14 wound around the ferrite member 12, the power supply OC and the resonant capacitor C1. The second antenna ANT2 is provided with a parallel resonant circuit which is constituted by the parallel connection of the resonant capacitor C2 to the series connection of the second coil 13 wound around the bobbin 11 and the link coil 13*a* wound around the ferrite member 13. If a voltage is applied from the power source OC to the first antenna ANT1 in a series manner, the axis of a magnetic field component generated at the first antenna ANT1 and the axis of a magnetic field component at the second antenna ANT2 make an angle of 90 degrees to each other as can be understood from FIG. 2 showing an equivalent circuit of the device 10 shown in FIGS. 1(A) and 1(B). It is to be noted that in FIG. 2, reference symbols, L21 and L22 are inductances of the coils 14, 13*a*, and 13, respectively.

Figure 3:
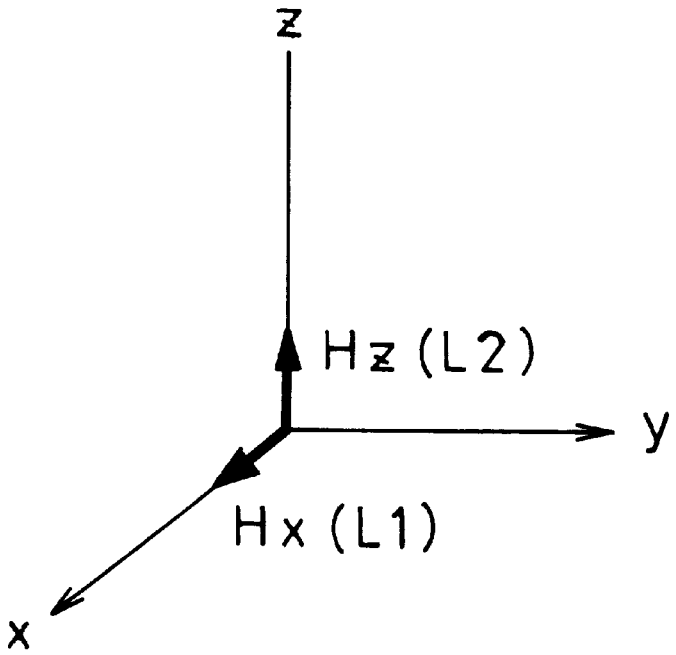
FIG. 3 is a view showing a direction relationship between two different magnetic fields generated in the loop antenna device shown in FIG. 1(A)

In the equivalent circuit shown in FIG. 2, if a high voltage, for example, a high frequency voltage, is applied from the power supply OC to the first coil 14, a magnetic field is generated at the first coil 14 of the first antenna ANT1 in the x-direction and consequently the link coil 13*a* is excited which induces an electric current in the second coil 13. In this case, as can be seen from FIG. 3 the direction of the magnetic field generated at each of the coils 13*a* and 14 extends in x-direction, while the direction of the magnetic field generated at the coil 13 extends in z-direction. Thus, as a whole, the magnetic field components of the loop antenna device 10 make an angle of 90 degrees to each other in axis.

It is to be noted that the coupling degree between the coils 14 and 13*a* or an inductance L21 can be controlled by adjusting the number of turns of the link coil 13*a*. To make a series resonance at the first coil 14 at a frequency f the values of the resonant capacitors C1 and C2 can be determined from the formula of $f=1/(2\pi\sqrt{LC})$.

An experiment is made by assembling the loop antenna device 10 under the following condition or rating, which reveals that the both of the magnetic components Hx and Hz cross at right angles to each other.

Bobbin 11: 72 mm×14 mm×4.5 mm

Clearance between the ferrite member 12 and the bobbin 11: 1 mm

Ferrite member 12: 66 mm×8 mm×2.5 mm

Coil 13: 26 turns (inductance: 64 $\mu$H)

Link coil 13*a*: 5 turns

Coil 14: 21 turns (inductance: 30 $\mu$H)

Capacitor C1: 0.047 $\mu$F

Capacitor C2: 0.022 $\mu$F

Frequency applied from Power Supply: 134 kHz

The foregoing embodiment offers a simplified structure of the loop antenna device due to the fact no dead spaces are defined between the two antennas. In addition, a simple coil winding adjustment establishes a substantial right angle cross-relationship between two magnetic fields generated at the first antenna ANT1 and the second, antenna ANT2.

Figure 4A:
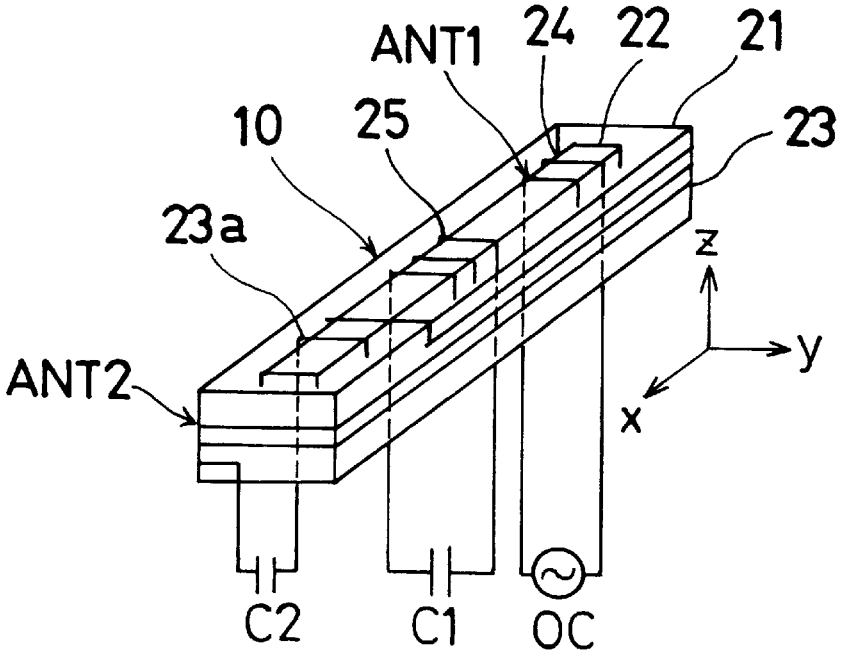
FIG. 4(A) is a perspective view of a second embodiment of a loop antenna device in accordance with the present invention.
Figure 4B:
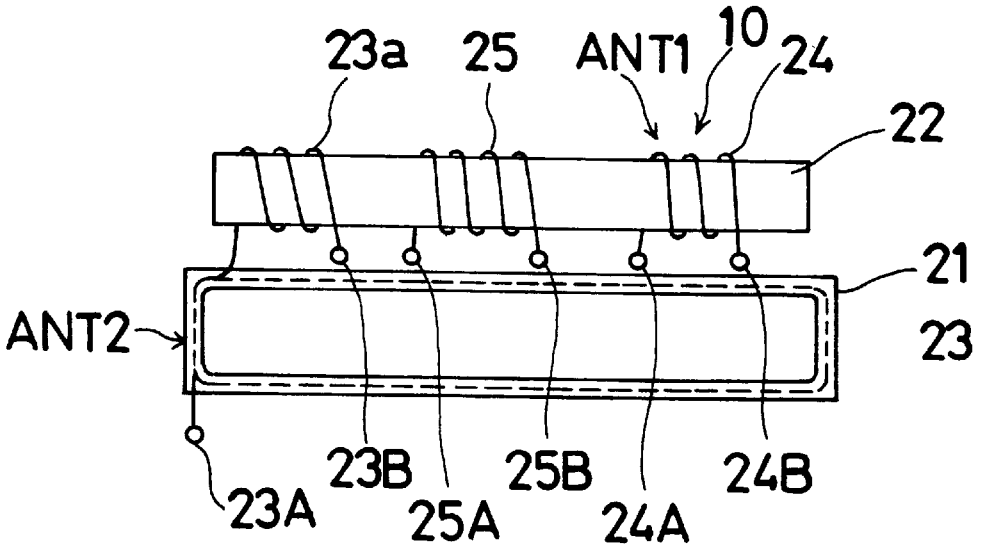
FIG. 4(B) is a view showing how coils are wound in first and second antennas in the loop antenna device shown in FIG. 4(A)
Figure 5:
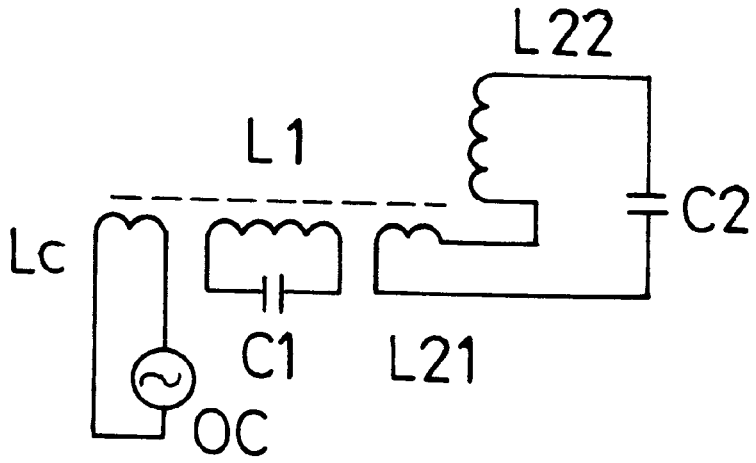
FIG. 5 is an equivalent circuit of the loop antenna device shown in FIG. 4.

Referring to FIGS. 4(A), 4(B) and 5, a second embodiment is disclosed wherein a ferrite member 22 of a first antenna ANT1 is accommodated within a bobbin 21 of a second antenna ANT2 such that a distance is defined therebetween. FIG. 4(B) shows how a coil 23 and a set of spaced-apart coils 23*a*, 25 and 24 are wound around the bobbin 21 and the ferrite member 22, respectively. Similar to the first embodiment, a part of the coil 23 is provided as a link coil 23*a* on the ferrite member 22.

A resonant capacitor C2 is connected between a terminal end 23A of the coil 21 wound around the bobbin 23 and a terminal end 23B of the link coil 23*a* wound around the ferrite member 22. A resonant capacitor C1 is connected between terminal ends 25A and 25B as well as a power supply OC is connected between terminal ends 24A and 24B of the coil 24. Such a structure offers an equivalent circuit as shown in FIG. 5 wherein the link coil 23*a*, the coil 24, and the coil 25 are connected in series with respect to the ferrite member 22. It is to be noted that reference symbols L1, L21, L22, and Lc denote inductances of the coils 25, 23*a*, 23, and 24, respectively.

That is to say, the first antenna ANT1 is provided with a parallel resonant circuit which is constituted by the parallel connection between of the coil 25 wound around the ferrite member 22 and the resonant capacitor C1, and the second antenna ANT2 is provided with a parallel resonant circuit which is constituted by the parallel connection of the resonant capacitor C2 to the series connection of the link coil 23*a* wound around the ferrite member 22 and the coil 23 wound around the bobbin 21. Such a structure enables the generation of two different magnetic fields at the first antenna ANT1 and the second antenna ANT2, respectively, by feeding electric power to the coil 24 wound around the ferrite member 22.

In detail, applying a voltage from the power supply OC to the coil 24 results in a generation of magnetic field at the coil 24 of the first antenna ANT1 in the x-direction. This leads to simultaneous excitations of the link coil 23*a* and the coil 25. In this case, an axis of the magnetic field Hx generated at each of the coils 23*a*, 24, and 25 is directed in the x-direction, while an axis of the magnetic field Hz generated at the coil 23 is directed in s-direction. Thus, both magnetic fields Hx and Hz cross at right angles to each other.

Figure 6:
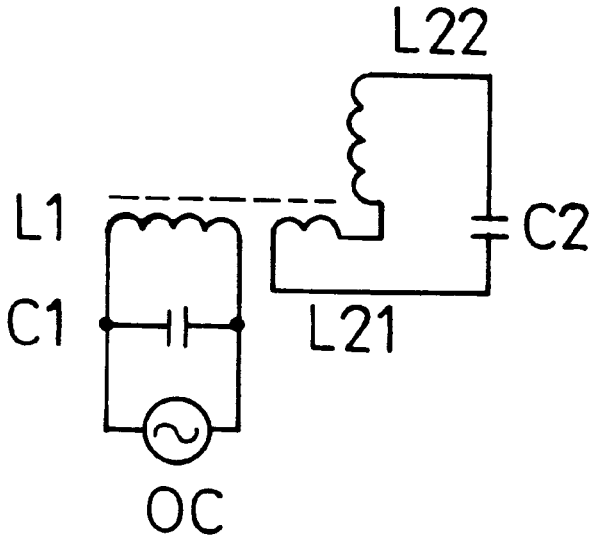
FIG. 6 is an equivalent circuit of a third embodiment of a loop antenna device in accordance with the present invention.
Figure 7A:
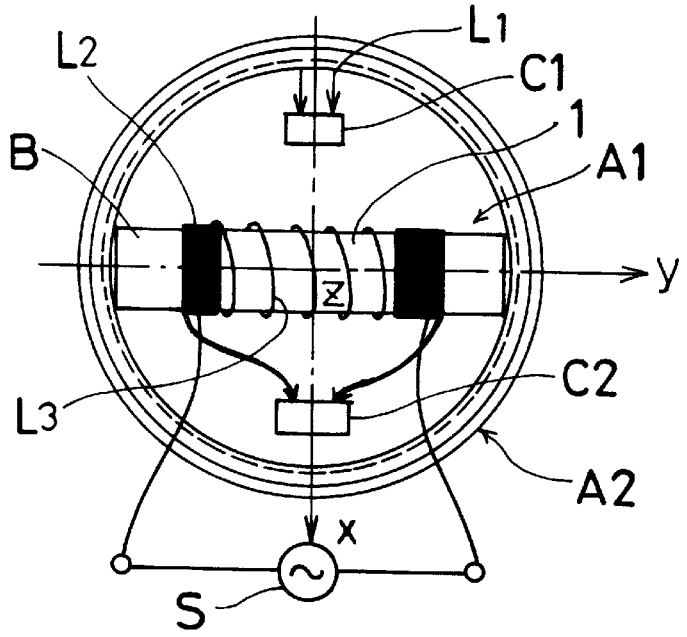
Fig. 7(A) (PRIOR ART)
FIG. 7(A) is a view showing an arrangement in a conventional loop antenna device.
Figure 7B:
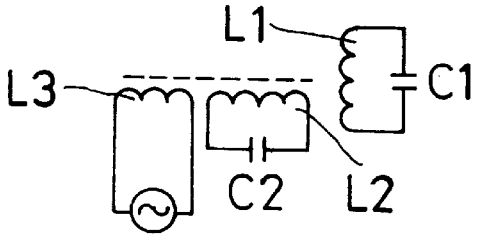
Fig. 7(B) (PRIOR ART)
FIG. 7(B) is an equivalent circuit of the loop antenna device shown in FIG. 7(A)
Figure 7C:
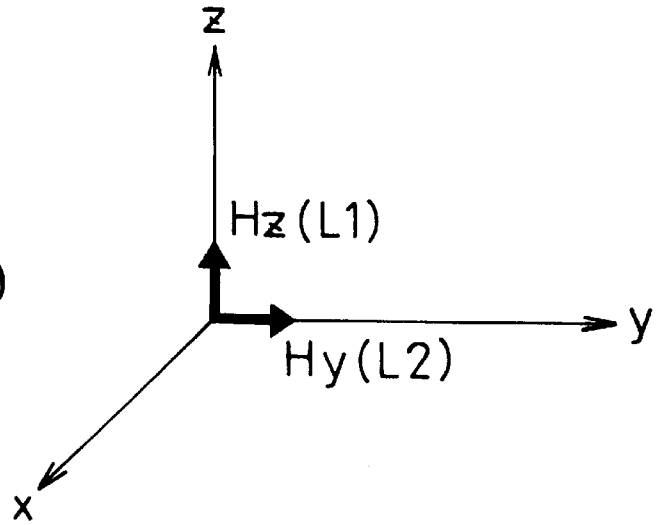
Fig. 7(C) (PRIOR ART)
FIG. 7(C) a view showing a direction relationship between two different magnetic fields generated in the loop antenna device shown in FIG. 7(A).

Instead of the equivalent circuit shown in FIG. 5, another equivalent circuit shown in FIG. 6 is available. In detail, to establish the equivalent circuit shown in FIG. 6, a first antenna ANT1 is provided with a parallel resonant circuit which is constituted by a parallel connection of a coil 25 wound around a ferrite member 22 and a resonant capacitor C1, and a second antenna ANT2 is provided with a parallel resonant circuit which is constituted by a parallel connection of a resonant capacitor C2 to the serial connection of a link coil 23*a* wound around the ferrite member 22 and a coil 23 wound around a bobbin 21 outside the first antenna ANT1. In the first antenna ANT1, applying the voltage to the coil 25 is accomplished by connecting a power source OC in parallel with the resonant capacitor C1.

The invention has thus been shown and description with reference to specific embodiments, however, it should be understood that the invention is in no way limited to the details of the illustrates structures but changes and modifications may be made without departing from the scope of the appended claims.

What is claimed is:

1. A loop antenna having a first antenna for generating a first magnetic field and a second antenna for generating a second magnetic field such that the first magnetic field and the second magnetic field each have a different axis, the loop antenna device comprising:

a series resonant circuit provided to the first antenna, the series resonant circuit comprising a ferrite member, a first coil wound around the ferrite member, a resonant capacitor, and a power source connected thereto in series, the series connection of the resonant capacitor and the power source being connected across the first coil in series; and a parallel resonant circuit provided to the second antenna, the parallel resonant circuit having a link coil wound around the ferrite member, a second coil connected to the link coil in series and wound around a member outside the ferrite member, and a resonant capacitor connected in parallel to the series connection of the second coil and the link coil.

2. A loop antenna having a first antenna for generating a first magnetic field and a second antenna for generating a second magnetic field such that the first magnetic field and the second magnetic field each have a different axis, the loop antenna device comprising:

a first series resonant circuit provided to the first antenna, the first series resonant circuit having a ferrite member, a first coil wound around the ferrite member, a resonant capacitor connected thereto in parallel;

a second parallel resonant circuit provided to the second antenna, the second parallel resonant circuit having a second coil wound around a member outside the ferrite member and a link coil connected thereto in series, and a resonant capacitor connected in parallel to the series connection of the second coil and the link coil;

a third coil wound around the ferrite member; and a power source connected across the third coil.

3. A loop antenna having a first antenna for generating a first magnetic field and a second antenna for generating a second magnetic field such that the first magnetic field and the second magnetic field each have a different axis, the loop antenna device comprising:

a series resonant circuit provided to the first antenna, the series resonant circuit having a ferrite member, a first coil wound around the ferrite member, a resonant capacitor, and a power source which are connected to each other in parallel; and a parallel resonant circuit provided to the second antenna, the parallel resonant circuit having a link coil wound around the ferrite member, a second coil connected to the link coil in series and wound around a member outside the ferrite member, and a resonant capacitor connected in parallel to the series connection.

4. A loop antenna device comprising:

a first antenna having a first coil for generating a first magnetic field; and a second antenna having a second coil for generating a second magnetic field such that an axis of the first magnetic field and an axis of the second magnetic field cross in an orthogonal manner to each other, a link coil extending from one end of the second coil, the second coil being magnetically coupled to the link coil by alignment thereof with the second coil, wherein the first antenna is of one of a series resonant circuit and a parallel resonant circuit, the second antenna is of a parallel resonant circuit.

* * * * *